US010309196B2

(12) United States Patent
Hered

(10) Patent No.: US 10,309,196 B2
(45) Date of Patent: Jun. 4, 2019

(54) REPEATEDLY PRESSURE OPERATED PORTED SUB WITH MULTIPLE BALL CATCHER

(71) Applicant: BAKER HUGHES, A GE COMPANY, LLC, Houston, TX (US)

(72) Inventor: William A. Hered, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 284 days.

(21) Appl. No.: 15/333,882

(22) Filed: Oct. 25, 2016

(65) Prior Publication Data

US 2018/0112494 A1 Apr. 26, 2018

(51) Int. Cl.

| | |
|---|---|
| ***E21B 34/14*** | (2006.01) |
| ***E21B 23/00*** | (2006.01) |
| ***E21B 21/10*** | (2006.01) |
| *E21B 34/00* | (2006.01) |

(52) U.S. Cl.

CPC ..... *E21B 34/14* (2013.01); *E21B 21/103* (2013.01); *E21B 23/004* (2013.01); *E21B 23/006* (2013.01); *E21B 2034/007* (2013.01)

(58) Field of Classification Search

CPC ..... E21B 34/14; E21B 21/103; E21B 23/004; E21B 23/006

See application file for complete search history.

(56) References Cited

U.S. PATENT DOCUMENTS

| | | | |
|---|---|---|---|
| 3,054,415 | A | 9/1962 | Baker et al. |
| 4,889,199 | A | 12/1989 | Lee |
| 5,048,611 | A | 9/1991 | Cochran |
| 5,339,914 | A | 8/1994 | Lee |
| 5,499,687 | A | 3/1996 | Lee |
| 6,173,795 | B1 | 1/2001 | McGarian et al. |
| 6,253,861 | B1 | 7/2001 | Carmichael et al. |
| 6,390,200 | B1 | 5/2002 | Allamon et al. |
| 6,467,546 | B2 | 10/2002 | Allamon et al. |
| 6,571,880 | B1 | 6/2003 | Butterfield, Jr. et al. |
| 6,732,793 | B1 | 5/2004 | Lee |
| 6,920,930 | B2 | 7/2005 | Allamon et al. |
| 6,923,255 | B2 | 8/2005 | Lee |
| 7,011,153 | B2 | 3/2006 | Erkol |
| 7,055,605 | B2 | 6/2006 | Howlett et al. |
| 7,347,288 | B2 | 3/2008 | Lee et al. |
| 7,500,526 | B2 | 3/2009 | Telfer |

(Continued)

*Primary Examiner* — D. Andrews
*Assistant Examiner* — Tara E Schimpf
(74) *Attorney, Agent, or Firm* — Shawn Hunter

(57) ABSTRACT

A ball seat is integrated with a movable biased sleeve. Sleeve movement against its bias moves a diverter from a position outside the through passage to a position across the main passage such that any balls that drop down will be directed by the diverter into an annular retention volume. In treatment of the formation for fluid loss the movement of a seat with the seated ball opens lateral ports for delivery of sealing material and moves the diverter. Smaller balls are then introduced to close lateral ports above the seated ball so pressure can be built to shift the sleeve and extrude the first ball. Once the seated ball blows through, the smaller balls come through the seat and are all diverted to an annular capture volume. The device is resettable for multiple operations. Fluid flow cessation closes lateral ports and opens a through passage retracting the diverter.

15 Claims, 3 Drawing Sheets

(56) References Cited

U.S. PATENT DOCUMENTS

| | | | | |
|---|---|---|---|---|
| 7,735,548 | B2 | 6/2010 | Cherewyk | |
| 7,954,555 | B2 | 6/2011 | Ashy et al. | |
| 8,118,101 | B2 | 2/2012 | Nelson et al. | |
| 8,245,788 | B2 | 8/2012 | Garcia et al. | |
| 8,356,671 | B2 | 1/2013 | Guillory et al. | |
| 8,739,864 | B2 | 6/2014 | Crider et al. | |
| 9,045,966 | B2 | 6/2015 | Ali et al. | |
| 9,303,475 | B2 | 4/2016 | Hart et al. | |
| 2010/0236782 | A1 | 9/2010 | Bruegger | |
| 2011/0315389 | A1 | 12/2011 | Crider et al. | |
| 2011/0315390 | A1 | 12/2011 | Guillory et al. | |
| 2012/0160515 | A1 | 6/2012 | Braekke et al. | |
| 2013/0299184 | A1* | 11/2013 | Ali | E21B 34/14 166/373 |
| 2016/0017690 | A1* | 1/2016 | Baudoin | E21B 23/006 166/318 |

* cited by examiner

REPEATEDLY PRESSURE OPERATED PORTED SUB WITH MULTIPLE BALL CATCHER

FIELD OF THE INVENTION

The field of the invention is ported subs capable of multiple cycles in conjunction with downhole ball catchers and more particularly where different sized balls can be diverted to an annular catch volume around a through passage with a diverter in one position and the through passage can be unobstructed with the diverter in a second position.

BACKGROUND OF THE INVENTION

Ball catchers are known in the art as described in U.S. Pat. No. 7,735,548 and US 2010/0236782. Their purpose is to stop balls blown through ball seats above from going further downhole and preventing operation of equipment further downhole, flow, or the ability to introduce other tools further downhole. One way to accomplish at least some of these objectives is to be able to store the captured balls in a volume outside the main passage. One device that captures a single ball outside a main passage is shown in U.S. Pat. No. 6,920,930, where the ball seat has a swing-away feature with the landed ball that, when swung, gets out of the main passage. A sleeve is then pushed down to trap the ball and the seat in a surrounding annular space while leaving the main passage open. The limitation of this device is that it can handle only one ball so if there are multiple balls involved, then multiple ball catchers each having a seat to accept a different sized ball is needed. In fracturing applications, there can be as many as dozens of balls blown through seats that need to be captured, making this device impractical for space and cost reasons.

More recently, another idea is described in U.S. Pat. No. 8,118,101 which can handle multiple balls of different sizes but uses an axially movable biased sleeve with a restriction in the main passage. Smaller balls than the restriction will just go through. The through passage is at all times restricted limiting further downhole operation or the delivery of tools to locations below the catcher.

The present invention presents a ball catcher actuated with displacement of a biased sleeve to force a diverter to the diverting position. As applied pressure is relieved by blowing a seated ball through a seat, other balls landed above the seated ball also make the trip through the seat and are diverted into an annular catch volume by a diverter held in a diverting position by continuing flow through the sleeve. As the flow through the sleeve is reduced or removed, a torsion spring returns the diverter to the open main passage position. These and other aspects of the present invention will be more readily apparent from a review of the detailed description of the preferred embodiment and the associated drawings while recognizing that the full scope of the invention is to be determined by the appended claims.

SUMMARY OF THE INVENTION

A ball seat is integrated with a movable biased sleeve. Movement of the sleeve against its bias moves a diverter from a position outside the through passage to a position across the main passage such that any balls that drop down will be directed by the diverter into an annular retention volume. In treatment of the formation for fluid loss, the movement of a seat with the seated ball opens lateral ports for delivery of sealing material. The shifting of the seat also move the diverter into the main through passage. Smaller balls are then introduced to close lateral ports above the seated ball so pressure can be built extrude the first ball. Once the seated ball blows through, the smaller balls come through the seat and are all diverted to an annular capture volume. The device is resettable for multiple operations. The cessation or reduction of fluid flow reopens the main through passage as the diverter is retracted.

DETAILED DESCRIPTION OF THE PREFERRED EMBODIMENT

Figure 1:
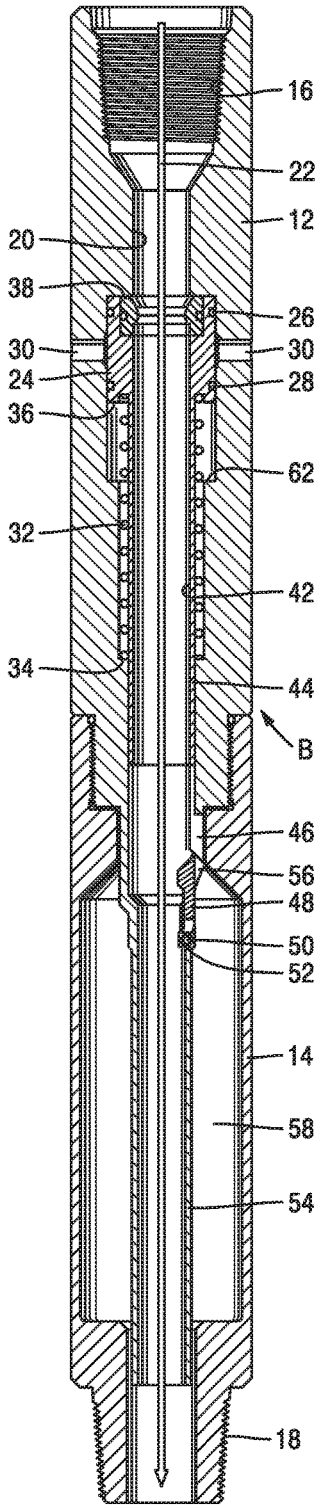
FIG. 1 is a section view of the tool in a run in position.
Figure 4:
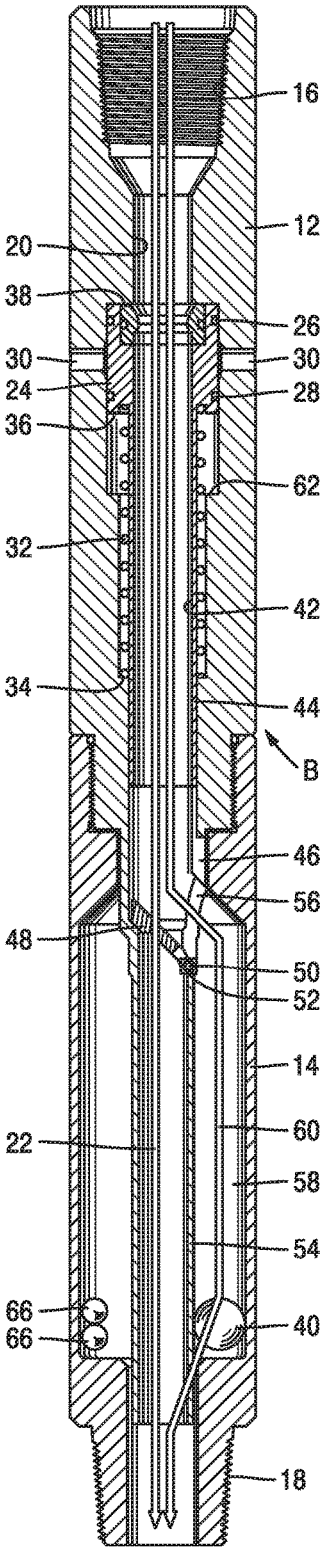
FIG. 4 is the view of FIG. 3 where the seated ball is blown through the seat and it and the small balls are captured in an annular capture volume.

Referring to FIG. 1, the ball catcher B has an upper housing 12 connected to a lower housing 14. A drill string that is not shown is connected above to connection 16 and below to connection 18. A through passage 20 extends through housing components 12 and 14. Arrow 22 shows flow through the ball catcher B in the run in position. A piston 24 has spaced seals 26 and 28 that straddle lateral ports 30 allowing piston 24 to act as a valve member for ports 30. A spring 32 pushes off a shoulder 34 in upper housing 12 to put an uphole force on surface 36 of piston 24. A ball seat 38 is supported by piston 24 such that without a seated ball 40 on seat 38 the through passage 20 is open between connections 18 and 16. Connected to piston 24 is an extension tube 42 that ends at a lower end 44. Continuing below the lower end 44 is an extending segment 46 that is disposed radially outside of a diverter or flapper 48 that pivots above a pin 50 that has a torsion spring 52 about pin 50 that biases the diverter or flapper 48 toward the FIG. 1 position where the diverter or flapper 48 is retracted out of the passage 20. Pin 50 is connected to extension tube 54 that is a part of the upper housing 12. In the FIG. 1 position a lateral opening 56 is closed by a flapper 48 but flow through or around the diverter or flapper 48 is possible into annular capture volume 58 defined between extension tube 54 and lower housing 14. Note that the volume 58 is not sealed so that flow that is diverted through opening 56 as indicated by arrow 60 in FIG. 4 rejoins flow through passage 20 as indicated by arrow 22.

Figure 2:
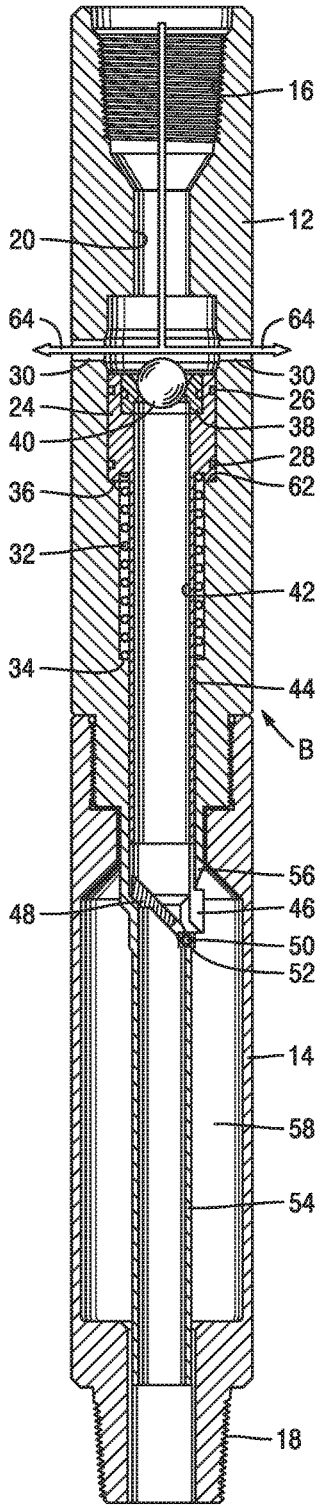
FIG. 2 is the view of FIG. 1 with a seated ball and pressure applied to open lateral ports.
Figure 3:
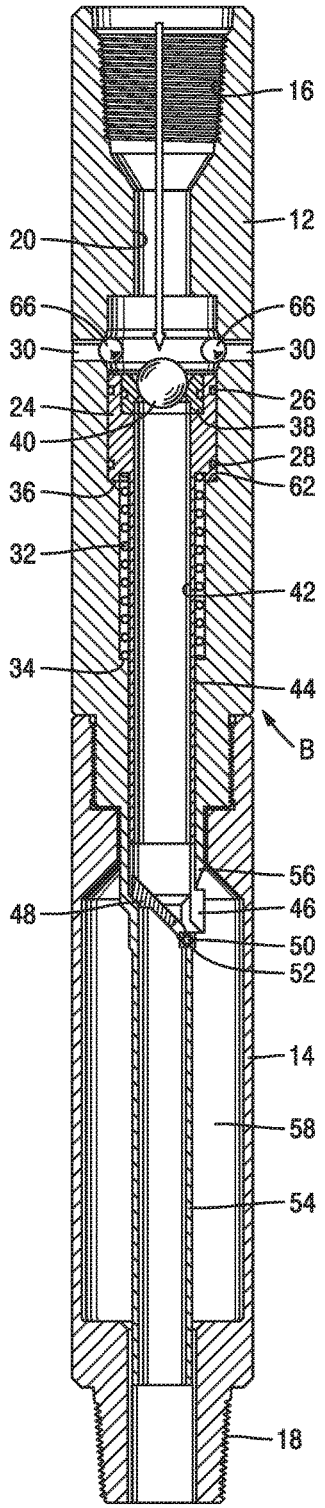
FIG. 3 is the view of FIG. 2 with treatment through the lateral ports completed and small balls delivered to close the lateral ports.
Figure 5:
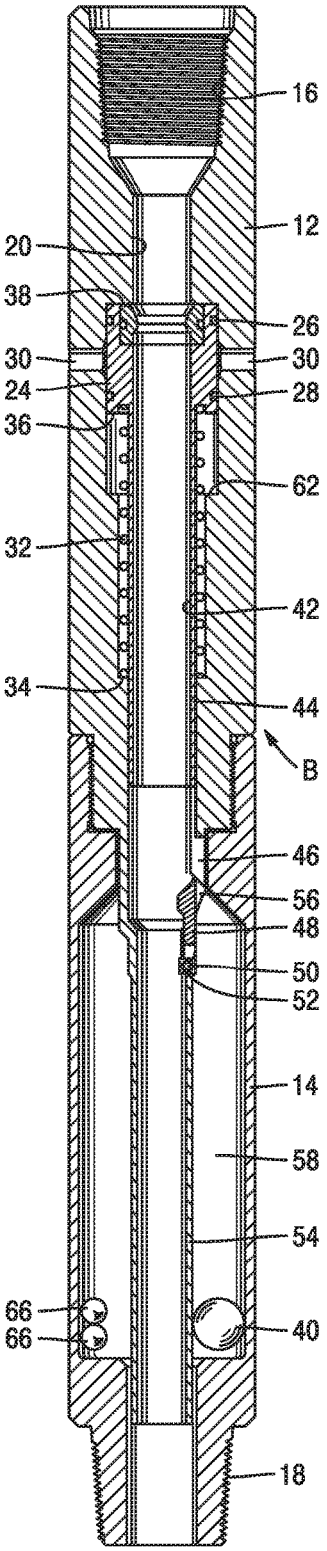
FIG. 5 is the view of FIG. 4 where flow is removed allowing a spring to move the seat up to close the lateral ports and retract the diverter from the main passage.
Figure 6:
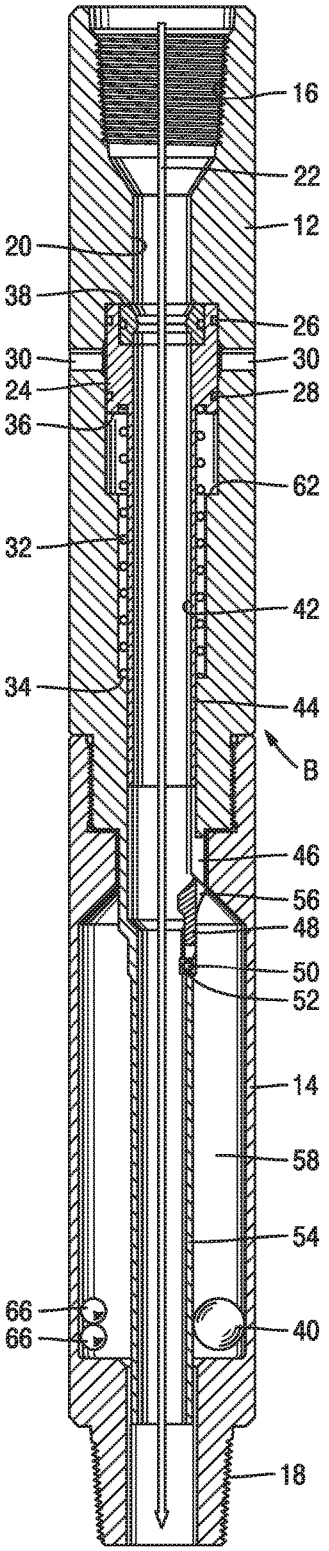
FIG. 6 shows resumption of flow through the main passage with the diverter retraced from the main passage.

Referring back to FIG. 2, when fluid losses to the formation are detected and there is a need to stop such loss such as during drilling, the ball 40 is landed on seat 38 and pressure is built up on seated ball 40 to move piston 24 against stop 62 so that ports 30 open for flow as indicated by arrows 64. When the sealant pumping to stop the fluid loss to the formation is concluded, another ball 66 is delivered into the catcher B for each lateral opening 30. Although two are shown, the amount of the openings 30 can be less or more. Once a ball 66 is in each opening 30, built up pressure blows ball 40 through seat 38 which sends ball 40 against the now displaced diverter 48 that is in the passage 20 so that passage 56 is open and ball 40 is captured in volume 58. Looking at FIG. 4, when the ball 40 blows through seat 38, it allows spring 32 to push piston 24 back to the FIG. 1 position. It also allows the two illustrated balls 66 to release from being up against ports 30 such that balls 66 fall against the diverter 48 and through opening 56 and into capture volume 58. The movement of piston 24 under force from spring 32 also moves extending segment 46 from the FIG. 3 position where it forced the diverter 48 to rotate into passage 20 and stay in that position by overcoming the force of torsion spring 52. On pressure release from blowing ball 40 through seat 38, the movement of piston 24 and connected extension tube 42 can experience enough of a viscous drag force due to forcing fluid into the spring chamber through a restriction with the upper housing 12 to ensure that the diverter 48 remains in the FIG. 4 position long enough for the fluid to reach and hold the diverter 48 down into the passage 20. Alternatively, the movement of the piston 24 and associated tube under the force of spring 32 can also involve pushing oil through an orifice (not shown) as a way to regulate the speed of the movement of piston 24 over a long enough period of time to let the diverter 48 to remain in passage 20 until all balls 66 are diverted. FIG. 5 shows the piston 24 again blocking ports 30 so that pumping straight through passage 20 can resume as the diverter 48, now no longer biased by the extending segment 46 that has moved up with the piston 24 or by impinging fluid flow, is returned to a retracted position out of passage 20 due to the action of torsion spring 52. In FIG. 6, as in FIG. 1, arrow 22 indicates the straight through flow through passage 20 can resume. The above process can be repeated many times with the limitation being the capacity of volume 58 to store balls without a trip out of the hole to remove the captured balls. Balls 66 can be smaller than ball 40 making the device capable of catching multiple balls of different sizes in a device that does not restrict the drift dimension of the through passage 20.

Figure 7:
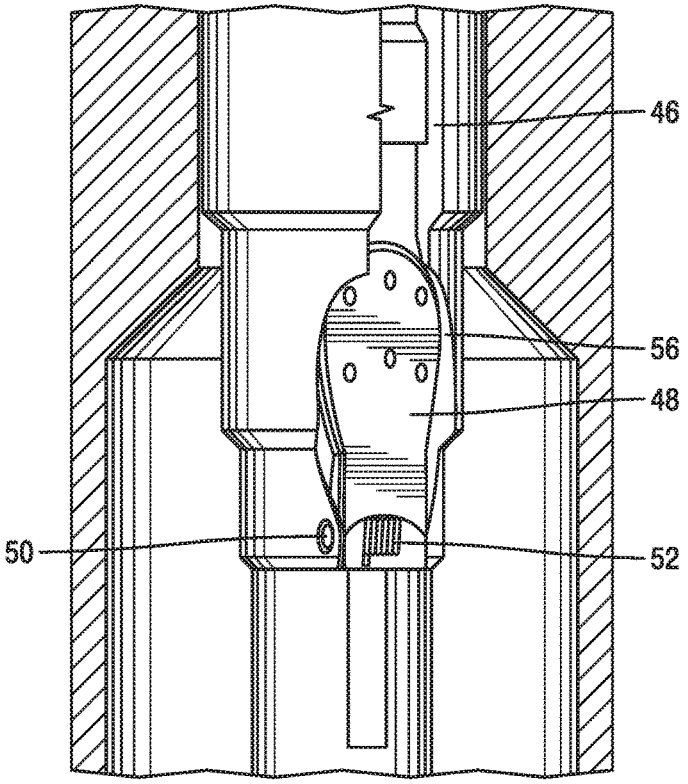
FIG. 7 is another view of the diverter in the FIG. 1 position.
Figure 8:
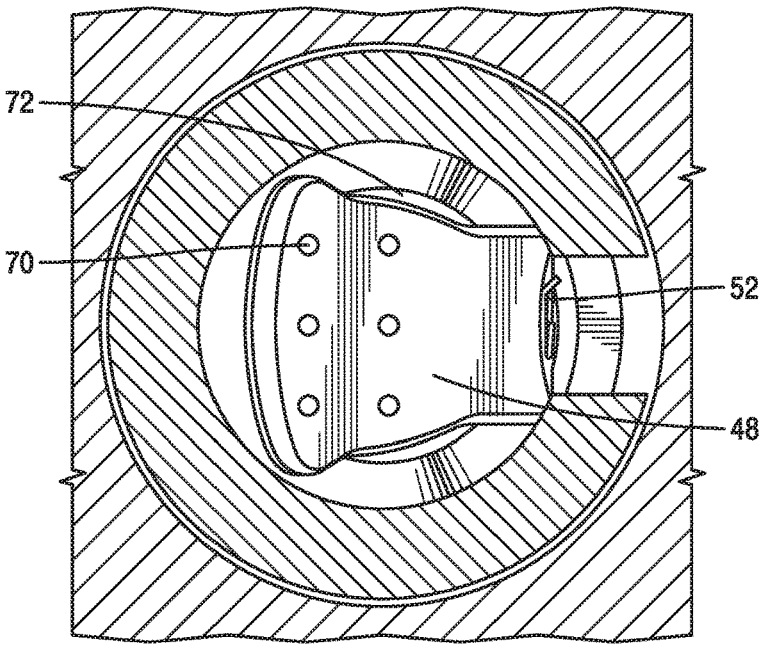
FIG. 8 is an end view of the diverter through the passage in the ball catcher when the diverter is in the FIG. 4 position.

FIGS. 7 and 8 show different views of the diverter 48. In FIG. 7 the FIG. 1 position is illustrated from a different perspective. FIG. 8 shows diverter 48 from an end view along passage 20 when the diverter 48 is in the FIG. 4 position. There can be openings 70 in the diverter and side gaps 72 to allow the diverter 48 to swing through an arc. The minimum ball size to be diverted is larger than openings 70 or gaps 72.

Those skilled in the art will appreciate that what is described is a ported sub with a selectively opened lateral port that is activated by tubing pressure in a drill string while the bit is selectively isolated so that sealer material can be pumped one or more times into a formation just drilled that is taking fluids. After sealant delivery the path to the bit can be reopened and the lateral ports closed so that drilling can resume. Reopening the path to the drill bit occurs from blowing a ball through a seat on a piston that selectively opens the lateral ports. The pressure is built on the seated ball by using smaller balls to seal off the lateral ports so that built up pressure on the seated ball is forced through the piston that selectively opens the lateral ports. A diverter directs the ball blown through the seat to an annular capture volume. The smaller balls can drop through the larger ball seat to be similarly diverted to the annular capture volume. Reducing flow rate allows a return spring to move the piston back to the run in position for more drilling with straight through pumping to the nozzles on the drill bit.

Although a drilling application is described, other applications are contemplated. The balls for the lateral ports can be the same size or a different size than the ball that lands on the seat of the piston. The lateral ports can be reopened one or more times by repeating the process with the limit being the size of the capture volume to hold all the balls outside the main passage.

The above description is illustrative of the preferred embodiment and many modifications may be made by those skilled in the art without departing from the invention whose scope is to be determined from the literal and equivalent scope of the claims below:

I claim:

1. A ported sub for a borehole tubular string, comprising:

a housing comprising at least one wall opening and a passage therethrough in flow communication with said wall opening, said passage comprising a selectively opened lateral exit to a surrounding capture volume in said housing;

a valve member for selective opening and closing of said at least one wall opening, said valve member operably connected to said lateral exit to direct at least one initial object to said surrounding capture volume; and wherein movement of said valve member in tandem with said initial object pivots a diverter into said passage to open access to said capture volume through said lateral exit.

2. The sub of claim 1, wherein:

said valve member operates the diverter between a retracted position from said passage and an extended position into said passage, said extended position defining said opened lateral exit to said capture volume.

3. The sub of claim 1, wherein:

said valve member is biased toward blocking said at least one wall opening.

4. The sub of claim 1, wherein:

said valve member has an axial opening surrounded by a seat to accept said at least one initial object for selective blocking of said passage while moving said valve member with pressure held by said initial object on said seat to said open position of said at least one wall opening.

5. The sub of claim 4, wherein:

movement of said valve member in tandem with said initial object opens said at least one wall opening.

6. The sub of claim 4, wherein:

movement of said valve member in tandem with said initial object compresses a return spring.

7. The sub of claim 4, further comprising:

at least one additional object adapted to block said at least one wall opening to allow further pressure on said initial object on said seat to pass the initial object through said seat to said diverter for capture in said capture volume.

8. The sub of claim 7, wherein:

said at least one additional object passing through said seat and onto said diverter for capture in said capture volume.

9. The sub of claim 8, wherein:

said valve member biased in a direction to close said at least one wall opening while moving away from said diverter;

wherein a change of fluid flow through said seat after said initial object passes therethrough allows said diverter to move out of said passage.

10. The sub of claim 9, wherein:

said diverter is pivotally mounted to a pin with a torsion spring on said pin to bias said diverter out of said passage.

11. The sub of claim 9, wherein:

movement of said valve member in said direction to close said at least one portion is delayed to allow said at least one additional object or fluid flow time to engage said diverter.

12. The sub of claim 11, wherein:

said delay is accomplished by a restrictive fit of at least a part of said valve member with said housing or by said valve member displacing fluid through a restriction.

13. The sub of claim 7, wherein:

said at least one additional object is smaller than said at least one initial object.

14. The sub of claim 1, wherein:

said valve member has an axial opening to conduct flow through said passage.

15. The sub of claim 1, wherein:

said valve member is movable to open and close said at least one wall opening multiple times.

* * * * *